US006402630B1

(12) United States Patent
Tyler

(10) Patent No.: US 6,402,630 B1
(45) Date of Patent: Jun. 11, 2002

(54) BOWLING BALL

(76) Inventor: Nelson Tyler, 15801 Royal Oak Rd., Encino, CA (US) 90436

( * ) Notice: Subject to any disclaimer, the term of this patent is extended or adjusted under 35 U.S.C. 154(b) by 0 days.

(21) Appl. No.: 09/828,605

(22) Filed: Apr. 6, 2001

(51) Int. Cl.[7] ..... A63H 17/36
(52) U.S. Cl. ..... 473/125; 446/454
(58) Field of Search ..... 473/569, 125; 446/456, 457, 458

(56) References Cited

U.S. PATENT DOCUMENTS

| | | | |
|---|---|---|---|
| 183,549 A | | 10/1876 | Dunham |
| 508,558 A | | 11/1893 | Tate |
| 624,962 A | | 5/1899 | Norton |
| 3,591,177 A | | 7/1971 | Skuse |
| 3,798,835 A | | 3/1974 | McKeehan |
| 4,058,310 A | | 11/1977 | Miettinen |
| 4,099,715 A | | 7/1978 | Caplan |
| 4,194,317 A | | 3/1980 | Kidd |
| 4,391,224 A | | 7/1983 | Adler |
| 4,501,569 A | | 2/1985 | Clark, Jr. et al. |
| 4,541,814 A | | 9/1985 | Martin |
| 4,726,800 A | | 2/1988 | Kobayashi |
| 5,041,051 A | | 8/1991 | Sonesson |
| 5,058,901 A | | 10/1991 | Salvino |
| 5,297,981 A | | 3/1994 | Maxim et al. |
| 5,439,408 A | | 8/1995 | Wilkinson |
| 5,533,921 A | | 7/1996 | Wilkinson |
| 5,871,386 A | * | 2/1999 | Bart et al. |

FOREIGN PATENT DOCUMENTS

| | | | |
|---|---|---|---|
| DE | 4218712 A1 | * | 9/1993 |
| DE | 19617434 | * | 7/1996 |
| WO | WO-97/01381 | * | 1/1997 |

* cited by examiner

*Primary Examiner*—William M. Pierce
(74) *Attorney, Agent, or Firm*—Joseph F. McLellan

(57) ABSTRACT

A bowling ball having an internal weight whose position is adjustable by a remote controller for altering the path of the ball after it is released by the player.

16 Claims, 5 Drawing Sheets

BOWLING BALL

BACKGROUND OF THE INVENTION

1. Field of the Invention

The present invention relates to a bowling ball having an internal weight whose position is adjustable by a remote controller for altering the path of the ball after it is released by the player.

2. Description of the Prior Art

The conventional way of using a bowling ball is to roll it over the surface of a bowling alley in a direction best calculated to knock over the bowling pins at the far end of the alley. A player has no control over the path of the ball once it is released.

The path of travel of the ball can initially be controlled to a certain extent by the spin or hook a player imparts to the ball on release. Beyond the release point there is nothing a player can do to correct the path of an errant ball, much as the player would like otherwise.

In U.S. Pat. No. 5,058,901 (Salvino) issued Oct. 22, 1981 the inventor observed that when weight is drilled or otherwise removed from the ball to provide thumb and finger holes, the path of the ball was adversely affected by the resulting change in the center of gravity of the ball. According to the patent, this dynamically unbalanced condition could be corrected by locating a rod along the spin axis of the ball. The consequent increase in weight along that axis was designed to reduce the tendency of the ball to wobble after it was released. The axial position of the rod was adjustable between each use to some position that the player felt would be most likely to establish the best path for the ball as it rolled down the alley. It is likely that precise placement of the rod was not easy to achieve since most players "hook" a ball to a varying extent during play and this, together with other variables such as the state of the bowling alley surface, would make it difficult to consistently reach a predictable result. In any event, the arrangement did not provide any dynamic control of the ball. The system amounted to a trial and error procedure in which a player was always trying to match his bowling results with various fixed positions of a rod in the ball. It was not possible to control the path of the ball after it was released.

U.S. Pat. No. 3,591,177 (Skuse) discloses an invention generally similar to the '901 patent just discussed except that a threaded rod was used. Its axial position was adjusted by rotating it along a threaded bore using a screwdriver inserted into an access opening from the exterior of the ball. However, during play the position of the rod was fixed. Dynamic adjustment was neither taught nor suggested as being desirable.

A somewhat related arrangement is shown in U.S. Pat. No. 4,058,310 (Miettinen), except that he uses mercury to alter the location of the ball's center of gravity. The mercury is located in one of three elongated chambers that extend radially outwardly from the center of the ball. One or the other of these chambers is filled with the mercury through a three-way valve whose rotated position is changed when a chamber is filled with the desired amount of mercury. The stem of the valve extends outwardly from the center of the ball, and is turned by a key that is inserted through the exterior surface of the ball. The key thus controls which chamber is filled, and to what extent. However, like the other patents discussed above, the position of the valve and other adjustable components are fixed and cannot be changed once the ball has been released for travel down the alley. No dynamic control of the ball path is possible.

A system is disclosed in U.S. Pat. No. 4,501,569 (Clark Jr. et al) for remotely and dynamically controlling the location of the center of gravity of a spherical vehicle is disclosed. The mechanism includes an elongated axle which extends diametrically along the spin axis of the sphere. The ends of the axle are fixed within the sphere, and a frame which supports the axle is rotatable about the transverse or spin axis of the sphere. An axle gear is fixed to the axle and engaged by a pinion gear. The pinion gear is rotatable by the drive shaft of a motor that is attached to the frame. As a consequence, rotation of the pinion gear rotates the motor and frame about the axle.

Attached to the frame is the inner end of a radially extending pendulum arm whose outer end carries a mass or weight. The frame includes an integral arcuate gear rack that is engaged by the pinion gear of a servo motor which, like the weight, is mounted to the pendulum arm. Rotation of the servo motor thus causes the arcuate gear segment and weight to rotate to one side or the other of the spin axis along which the axle extends.

The servo motor is operable by a remotely located radio transmitter whereby adjustment of the location of the center of gravity of the mass is done dynamically.

A similar result is achieved by the system of U.S. Pat. No. 4,726,800. (Kobayashi) wherein a center-shaft within the spherical toy extends along the spin axis of the toy. The system is controlled by a remotely located radio transmitter that operates a radio receiver within the toy. This in turn operates a battery in the toy to energize a servo motor. The output or drive shaft of the motor is coupled to a relatively complex connecting structure which is operative to move a direction control means to one side or the other of an axis generally perpendicular to the spin axis of the toy. This adjusts the center of gravity of the toy to thereby dynamically adjust the path the toy follows as it rotates on its spin axis. Although the path of the toy is controlled remotely by a radio transmitter, the structure provided to translate these control signals into a desired relocation of the center of gravity is quite complex and would be expensive and time consuming to manufacture and maintain.

SUMMARY OF THE INVENTION

According to the present invention, the path of a bowling ball is dynamically adjusted during its travel down the bowling alley or lane by the straightforward expedient of moving a mass or weight transversely along the spin axis of the ball to precisely locate the center of gravity where necessary to control the path of the ball.

An embodiment is disclosed which does this in a way that lends itself to competition between pairs of partners. The ball path is best controlled if the ball is released for straight ahead rotation essentially about its spin axis without hooking or the like. One partner in each team is responsible for releasing it along the desired straight path utilizing, as will be seen, a special finger hole or holes uniquely arranged according to the invention. As the ball travels down the alley the other partner controls the exact path of the released ball by operating a hand held radio transmitter which is in communication with a radio receiver in the ball. The radio receiver responds to the transmitter control signals to move the weight axially along the spin axis in a direction dictated by the signals.

The present ball path direction control apparatus is easy and relatively inexpensive to manufacture and maintain, and its use permits a sense of cooperation between the partners of a team, as well as competition between different teams.

In one embodiment the ball is formed into its characteristic spherical shape by joining a pair of hollow hemispherical portions. The weight which is movable for adjusting the location of the center of gravity is located within a frame that is mounted within the hollow interior of the ball.

In one embodiment the motor which is operative to move the weight is located within the frame. An externally threaded drive shaft of the motor is oriented along the ball spin axis, and is rotatable to move the weight axially along the spin axis. In another embodiment the motor is located within the ball, but exteriorly of the frame. In the latter arrangement the drive shaft is connected by belts and pulleys to the shaft which supports the weight within the frame.

In both embodiments the weight includes an internally threaded bore which engages external threads on the shaft to which the weight is mounted. The shaft extends along the spin axis, and the weight includes external walls, or is otherwise configured for complemental engagement with the interior walls of the frame space within which the weight is received. The interengaging walls are made flat or otherwise configured so that rotation of the shaft will not rotate the weight. Instead, the exterior walls of the weight are axially slidable upon the interior walls of the frame space so that rotation of the shaft axially moves the weight.

As previously mentioned, the present bowling ball is provided with one or more finger holes located along a centerline or axis parallel to the spin axis of the ball. Each hole is adapted to receive one or two fingers, and extends downwardly into the ball and then forwardly to define a ledge or shelf that can be grasped by the fingers as a form of finger "handle". If desired, the ball can be provided with two or more separate finger holes, each with a ledge or shelf for receiving one or two fingers. The usual thumb hole is preferably eliminated because its presence would mean the thumb and finger holes would have to be precisely arranged for each player. Using finger holes alone makes it possible for a ball to have a "universal" finger hole arrangement capable of fitting many persons. Any need for precise location of the relative positions of thumb and finger holes is thus completely eliminated. If the player insists upon a thumb hole, the thumb hole is preferably a straight bore with no shelf so the ball can easily drop off the thumb.

Providing a single larger hole for all four fingers rather than the above-described spaced finger holes is less desirable because this would result in the presence of a finger opening or cavity that would be so laterally elongated that the margins of the depressed central portion would engage and "thump" upon each rotation of the ball along the bowling lane.

Other objects and features of the present invention will become apparent from the following more detailed description taken in conjunction with the accompanying drawings.

DESCRIPTION OF THE PREFERRED EMBODIMENTS

Figure 1:
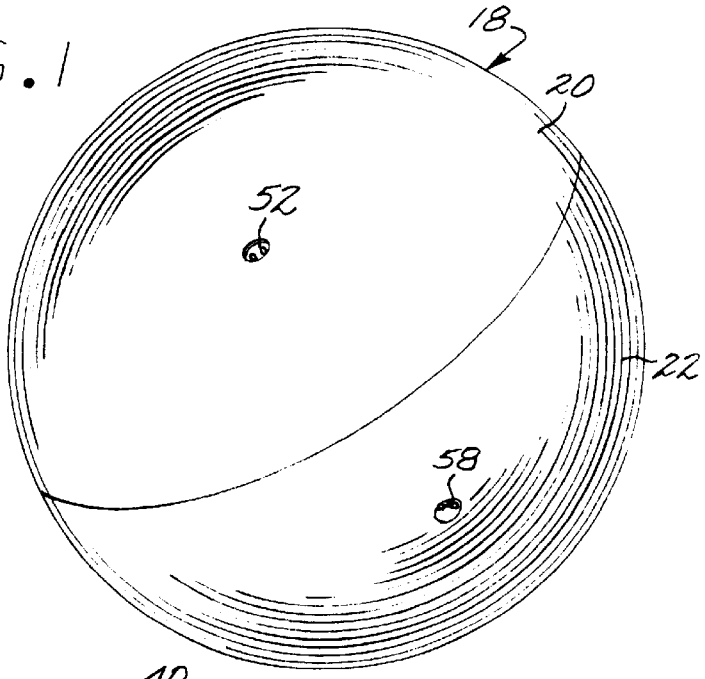
FIG. 1 is a perspective view of the bowling ball of the present invention, illustrating the two hemispherical portions connected together to form the spherical ball.

Referring now to the drawings, and particularly to FIGS. 1–10, a typical spherical bowling ball is illustrated which is adapted to be thrown or rolled down a bowling alley or lane (not shown). The path of the ball is intended to strike a set of bowling pins (not shown). A bowling ball of the prior art typically includes both a thumb hole and two finger holes to enable the player to better guide the ball along this path. In the prior art the holes are usually straight bores so that on release from a cradled position the ball will slide off the player's thumb and fingers onto the surface of the alley.

The use of both thumb and finger holes in the prior art enables a player to spin or hook the ball just as it is released. Such hooking has been found to be desirable in a conventional bowling match because it causes the ball to follow a curved path toward the pins. Without a hook the ball is likely to directly hit the head pin whereas a ball following a curved path is likely to hit both the head pin and the pin adjacent to it, causing a desired churning or "pin action" in which the pins interact and strike one another.

In direct contrast to the prior art, the ball of the present invention can be rolled along a substantially straight path because the usual thumb hole is preferably omitted. Without the thumb hole it is difficult to hook the ball. As will be seen, the usual finger holes are also preferably omitted. These changes in the typical bowling ball of the prior art better enable a player to throw the ball along a straight path. As will be seen, this enables a partner of the player to change the direction of the straight path to hit the pins in an optimum manner.

Figure 8:
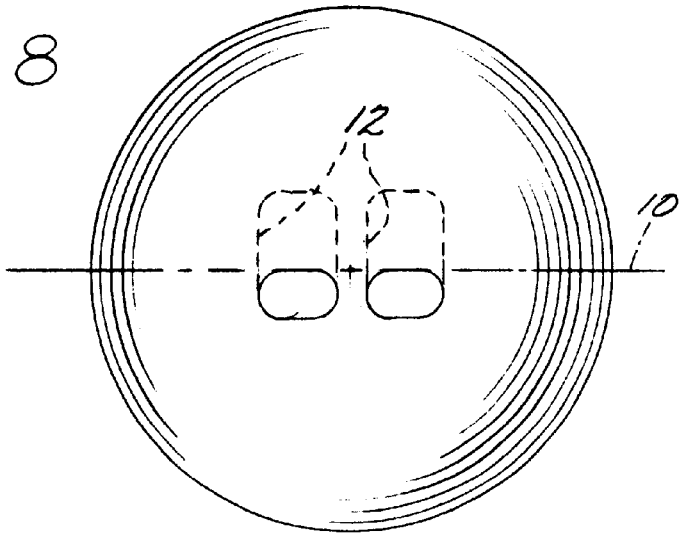
FIG. 8 is a side elevational view of the present bowling ball, illustrating in dotted outline the location and form of one arrangement of finger holes.
Figure 9:
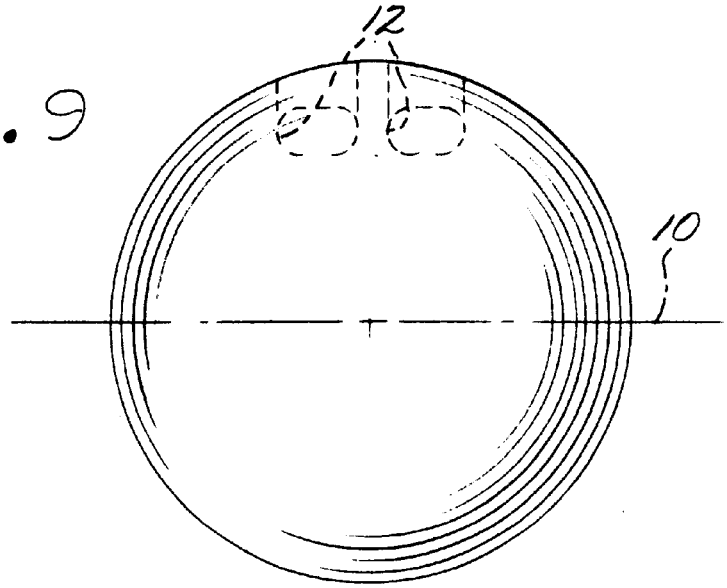
FIG. 9 is a top plan view of the structure illustrated in FIG. 8.
Figure 10:
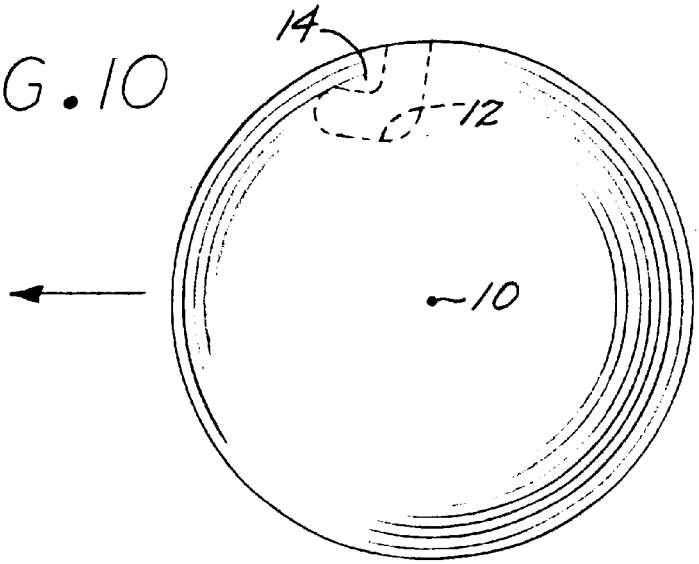
FIG. 10 is a rear elevational view of the bowling ball of FIG. 8.

As best seen in FIGS. 8–10, the ball of the present invention has a characteristic, substantially horizontally and transversely oriented spin axis 10 about which the ball spins as it travels down the bowling alley.

The ball of FIGS. 8–10 includes two adjacent finger holes 12 located on a centerline which extends generally parallel to the spin axis 10. Each finger hole 12 is preferably sized to accept two fingers. Two spaced apart holes are preferred over one large finger hole sized to accept four fingers. Such spacing avoids the "thumping" sound which would occur as the ball rolls down the alley.

Figure 11:
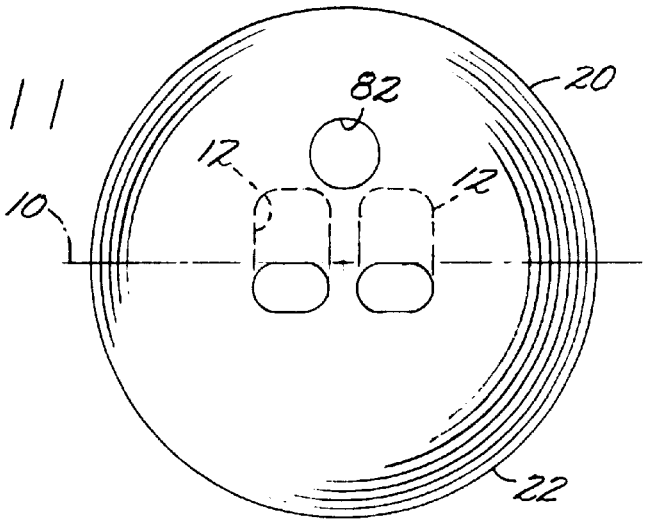
FIG. 11 is a side elevational view of finger holes and a thumb hole.
Figure 12:
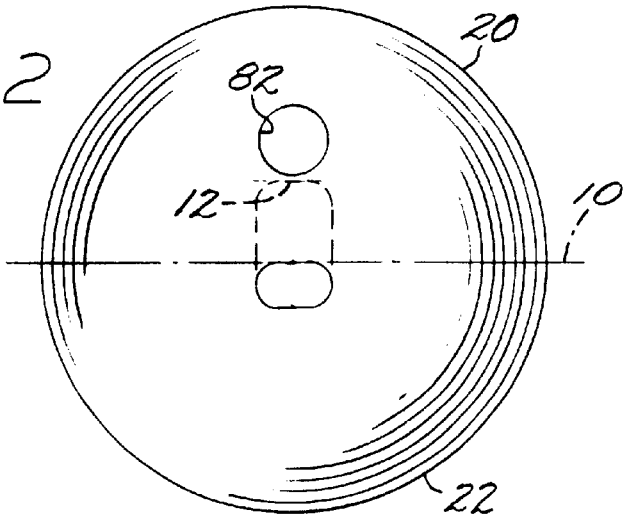
FIG. 12 is a side elevational view of a single finger hole and a thumb hole.

The finger holes 12 are not the usual straight bores of the prior art. Instead, each hole extends inwardly and then forwardly, as best seen in FIG. 8, to produce a rearwardly extending shelf or ledge 14. The player's fingers can then be placed beneath the shelves to support the weight of the ball even though there is no thumb hole. However, if a player feels more comfortable with a thumb hole, a thumb hole 82 can be included, as seen in FIGS. 11 and 12. The thumb hole 82 is preferably a straight bore, and does not include the curved section defined by the finger holes. The straight bore of the hole 82 enables the ball to slip off the hand without imparting any spin or hook to the ball.

Figure 2:
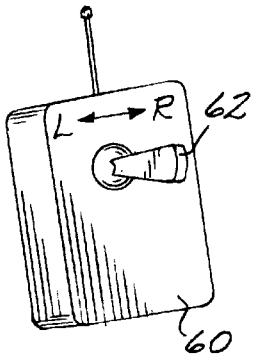
FIG. 2 is a perspective view of a handheld radio transmitter adapted to remotely control the path of the ball as it travels down a bowling lane.
Figure 3:
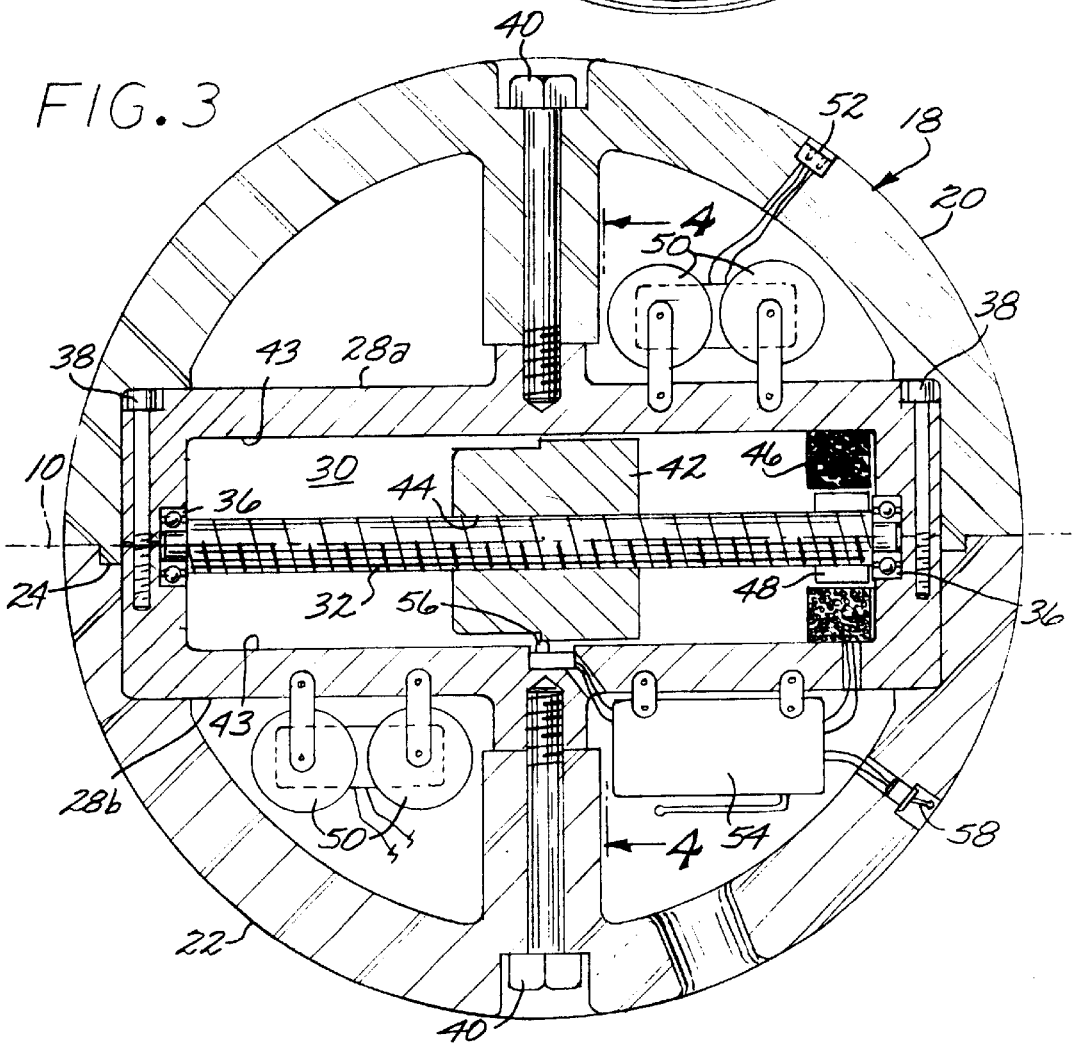
FIG. 3 is an enlarged cross section of the bowling ball.

As seen in FIGS. 1–3, the outer portion 18 of the spherical ball is formed of a pair of upper and lower hemispheres or halves 20 and 22 joined together at a joint 24.

A transversely elongated frame having upper and lower halves 28*a* and 28*b* is located within the hollow interior defined by the upper and lower halves 20 and 22. The frame extends parallel with the spin axis 10 and includes a hollow weight chamber 30 through which extends an externally threaded weight shaft 32 in alignment with the spin axis 10. The ends of the weight shaft 32 are rotatably supported within bearings 36 clamped between the ends of the two frame halves 28*a* and 28*b*.

The upper and lower halves 20 and 22 are clamped together and secured in position by bolts 40 which are threaded into the mid portions of the frame halves 28*a* and 28*b*.

Figure 4:
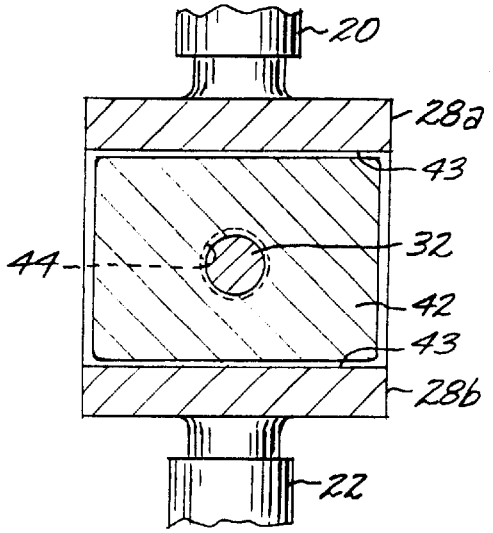
FIG. 4 is an enlarged cross section taken along the line 4—4 of FIG. 3.

A mass or weight 42 is located within the frame. As best seen in FIG. 4, it includes an internally threaded bore 44 which threadably engages the exterior threads of the weight shaft 32. The weight 42 is configured with flat outer sides or faces engageable with complemental sides or faces 43 of the frame to prevent rotation of the weight 42 when the weight shaft 32 rotates. Instead, rotational movement of the weight shaft 32 imparts threaded longitudinal or axial advancement of the weight along the weight shaft 32.

In the embodiment of FIG. 4, the weight 42 is square in cross section to provide flat upper and lower sides for engagement with corresponding flat surfaces 43 of the frame halves 28*a* and 28*b*. As will be apparent, other configurations of the weight 42 and the frame will occur to those skilled in the art which are operative to prevent relative rotation between the weight 42 and the frame, and yet allow longitudinal or axial movement of the weight on the frame when the weight shaft 32 is rotated. As will be apparent, the weight 42 will threadably advance along the shaft inwardly or outwardly, depending upon the direction of rotation of the weight shaft 32.

A suitable drive means or motor is provided for rotating the weight shaft 32. The form of motor illustrated in FIG. 3 comprises a stator 46 fixed to the frame 28, and a rotor 48 carried by the weight shaft 32. As will be clear to those skilled in the art, energization of the stator windings in one direction will rotate the weight shaft 32 in one direction, while energization of the stator windings in the opposite direction will rotate the weight shaft 32 oppositely.

The stator is coupled to batteries 50 mounted in the hollow interior or spaces defined by the upper and lower halves 20 and 22. The batteries are periodically charged by any suitable means, such as by a battery charger (not shown). A plug of the charger can be disposed within a socket 52 in the upper half 20 for connection to the batteries through suitable electrical leads.

Energization of the stator to move the weight 42 in one direction or the other is controlled by a radio receiver 54 which is mounted to the frame 28 and connected by suitable leads to the stator 46. As seen in FIG. 3, other electrical leads are provided to connect the receiver 54 to a microswitch or optical sensor 56. The sensor 56 is part of suitable circuitry located within the receiver 54.

Assuming the stator 46 has been energized to move the weight one way or the other, and a predetermined time interval of five seconds, for example, has passed, the circuitry, in conjunction with the sensor 56, energizes the stator 46 until the weight 42 is re-centered within the frame. The system is then able to move the weight 42 in either direction from the re-centered position, rather than from an extreme position near one end or the other of the weight shaft 32. When the ball is to be released, it should start to spin or roll with the weight in a centered position.

The radio receiver 54 includes an internal on-off circuit connected by suitable leads to a toggle switch 58 that is seated within an exterior recess in the lower half 22.

Referring now to FIG. 2, it will be apparent to those skilled in the art that the receiver 54 can be operated by radio signals from a remotely located hand held radio transmitter 60. This makes it possible for one member of a team to throw the ball, and the other to steer the ball with the transmitter 60. The goal of the team member throwing the ball is to release it in such a way that there is little or no hooking, only the normal spinning of the ball about its horizontal spin axis. If the ball spins essentially only around its spin axis, it should then follow a relatively straight path toward the pins. However, if this path is not aligned with the pins, the task of the other team member is to correct this by operating the transmitter 60.

Moving a toggle switch 62 one way transmits signals to the receiver to rotate the weight shaft 32 to rotate in one direction. Movement of the switch the other way causes an opposite rotation of the weight shaft 32, as will be apparent. Such transmitter/receiver combinations are well known in the art and details of their construction and operation are omitted in the interest of brevity.

Figure 13:
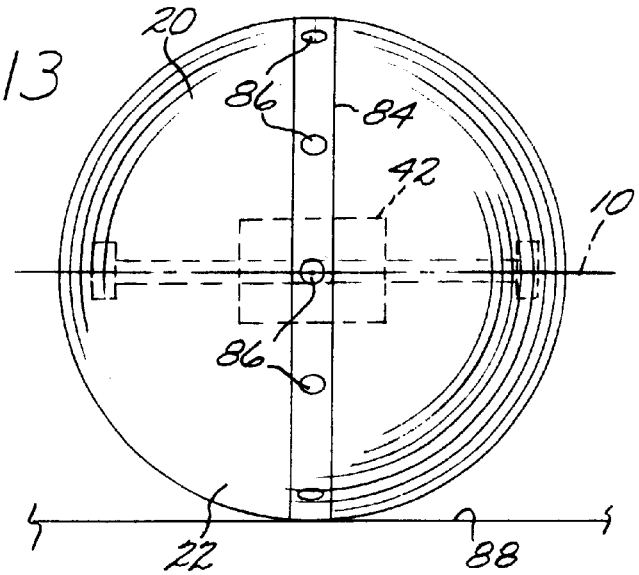
FIG. 13 is a front elevational view of a bowling ball according to the invention, and which includes a circular stripe extending around a center coincident with the spin axis, the stripe, if desired, also including a plurality of lights on the strip.

It is important that the team member operating the transmitter 60 be able to see if the ball has been thrown so as to spin along its horizontal spin axis since this dictates whether the ball will move in a straight path. According to the present invention, as will be explained later in conjunction with FIG. 13, a visual indicator, such as a stripe 84 or row of small lights 86, is provided on the ball to aid in determining if the ball is spinning only about its horizontal spin axis.

Figure 5:
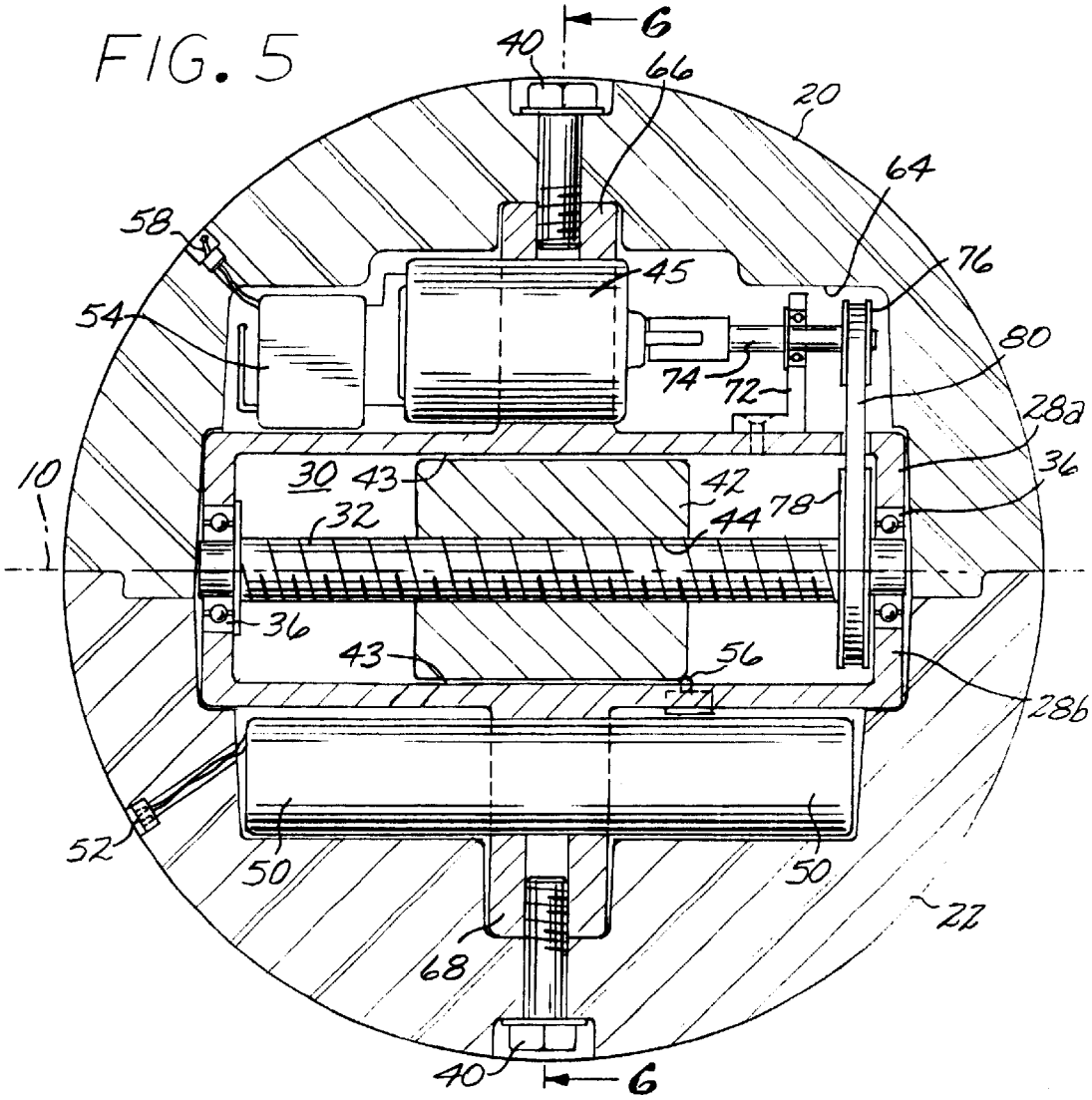
FIG. 5 is an enlarged cross section of a second embodiment of a bowling ball according to the present invention.
Figure 6:
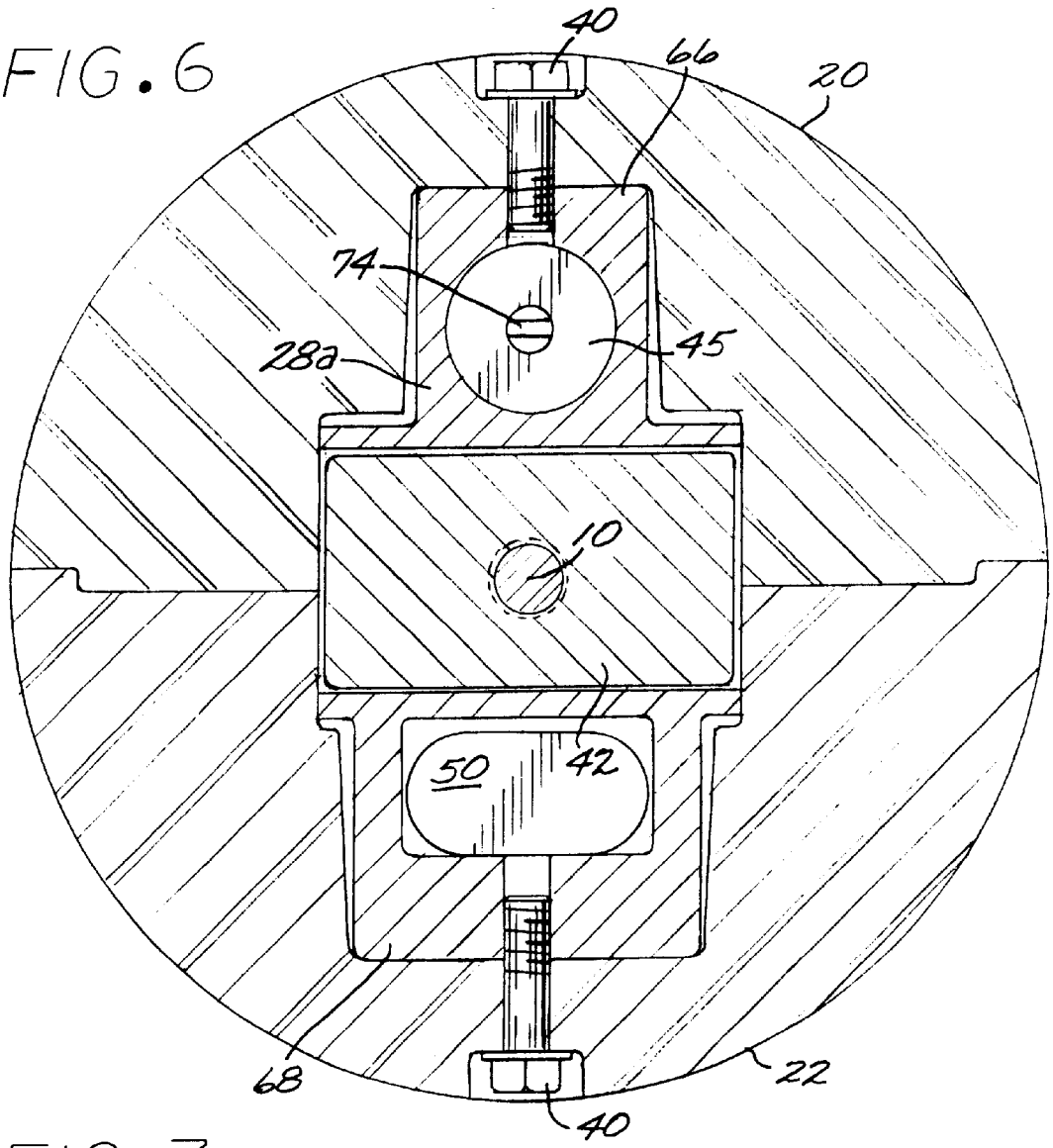
FIG. 6 is an enlarged cross section of the embodiment of FIG. 5.
Figure 7:
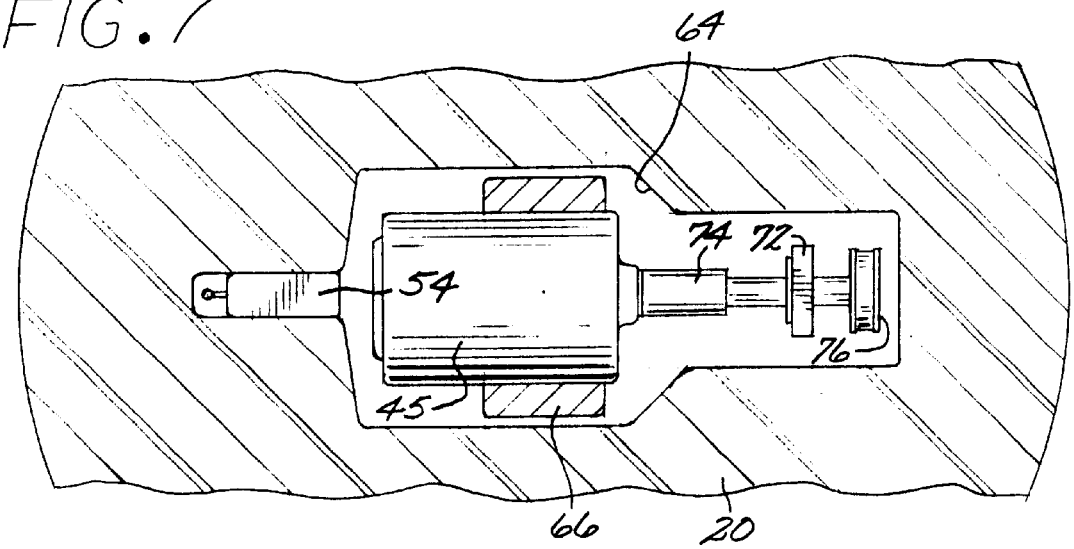
FIG. 7 is a top plan view of the motor, pulley and pulley belt assembly disposed within a cavity of the upper one of the hemispherical sections of the ball, with the adjacent ball structure shown in cross section.

Coming back to FIGS. 5–7, a second embodiment of the invention is disclosed which is substantially the same as the first embodiment except that the motor for rotating the weight shaft 32 is located externally of the frame. It has been found that this arrangement is less expensive to install and maintain because it enables use of a conventional off-the-shelf motor 45.

The motor 45 is located in a chamber 64 provided in the upper half 20 of the ball. The motor is fixed in this chamber by extending the motor through the bore of an upper extension 66 of the frame half 28*a*.

Hollow spaces 70 are also provided to house the receiver 54 and the batteries 50.

A motor shaft support 72 and associated bearings are attached to the top side of the frame half 28*a* for rotatably supporting a motor shaft 74 of the motor 45. The outer extremity of the motor shaft 74 mounts a pulley 76 that is coupled by a belt 80 to a pulley 78 that is mounted to the weight shaft 32. Other arrangements for connecting an externally located conventional motor 45 to the weight shaft 32 will be obvious to one skilled in the prior art.

The present invention makes possible the use of a relatively inexpensive bowling ball characterized by a remotely controlled inner weight, and a unique finger hole arrangement. This enables a pair of team members to compete with opposing team members to achieve a better score through control of the initial spin of the ball about its horizontal spin axis, and the subsequent steering of the ball after release. The degree of cooperation between members of a team, and the competition between the two teams, are important factors in a spirited competition to achieve the highest bowling score.

In use, the ball is released by one partner of a team in a way that will impart only a rolling of the ball over the bowling lane surface 88 and about its spin axis 10.

The other partner now has the task of controlling the ball so that its path will become aligned with the pins if it is not already aligned.

Whether the ball is rolling properly around its spin axis 10 can be determined by inspecting the stripe 84 or lights 86 that extend around the ball. If the spin is proper the stripe or lights will appear as a continuous vertically oriented band. If the spin is not proper the stripe or lights will not remain vertically oriented, but instead appear to wobble from side to side. This will enable the partner who threw the ball to adjust his release the next time to achieve the desired vertical orientation.

The stipe 84 and lights 86 may be provided independently or, as illustrated, the lights 86 can be embedded in the ball and used in conjunction with the stripe.

The lights 86 are powered by batteries (not shown) located in the hollow interior of the ball. The batteries and lights are preferably connected together using a well known centrifugal switch (not shown). The switch contacts are brought together by centrifugal force developed during rotation of the switch in the ball. This conserves battery power since the lights will be energized only when the ball is rotating.

The task of the second partner is to gauge the path of the ball and correct it if necessary by adjusting the center of gravity of the ball through skillful operation of the transmitter to properly locate the internal weight.

While preferred forms of the invention have been illustrated and described, it will be apparent that various modifications and changes can be made without departing from the spirit and scope of the invention.

What is claimed is:

1. A bowling ball comprising:

a spherical outer portion having a hollow interior;

a frame mounted within the hollow interior and defining an elongated weight chamber;

an elongated weight shaft mounted for rotation within the chamber;

a weight carried by the weight shaft within the chamber;

first means on the weight and on the frame cooperative to constrain the frame and weight against relative rotation upon rotation of the weight shaft, the weight being freely longitudinally movable upon the frame upon clockwise and counterclockwise rotation of the weight shaft, with the direction of longitudinal movement corresponding to whether the weight shaft is rotated clockwise or counterclockwise;

second means on the weight shaft and on the weight cooperative to urge the weight along the weight shaft in opposite directions, according to clockwise or counterclockwise rotation of the weight shaft; and drive means selectively operable for rotating the weight shaft clockwise or counter clockwise.

2. A bowling ball according to claim 1 wherein the outer portion comprises two halves which are connected together and separable to gain access to the frame.

3. A bowling ball according to claim 2 wherein a connector means extends through the two halves, respectively, and into the frame.

4. A bowling ball according to claim 3 wherein the connector means includes threaded bolts.

5. A bowling ball according to claim 1 wherein the frame is elongated and mounts the extremities of the weight shaft for rotation of the weight shaft.

6. A bowling ball according to claim 1 wherein the drive means comprises a motor located within the frame, the motor having a motor coil mounted to the frame and a motor magnet mounted to the weight shaft, the motor coil and motor magnet being adapted for clockwise or counterclockwise rotation, depending upon whether first or second control signals are applied to the motor coil.

7. A bowling ball according to claim 1 wherein the drive means comprises a motor mounted externally of the frame; a drive shaft rotatable by the motor; means connecting the drive shaft and the weight shaft for rotating the weight shaft, and battery means in the hollow interior for energizing the motor.

8. A bowling ball according to claim 2 and including drive means comprising a motor mounted externally of the frame; a drive shaft rotatable by the motor; means connecting the drive shaft and the weight shaft for rotating the weight shaft; battery means in the hollow interior for energizing the motor; and a pair of connectors connecting the two halves to the frame.

9. A bowling ball according to claim 8 wherein the drive means includes pulleys mounted to the drive shaft and to the weight shaft, respectively, and drive belt means mounted to the pulleys.

10. A bowling ball according to claim 1 and including a transmitter control means located remotely and externally of the spherical outer portion and having a control element movable in opposite directions to produce, respectively, first electrical signals and second electrical signals, respectively, and further including a receiver control means located within the spherical outer portion and operative to receive the first and second electrical signals and apply them to the drive means for rotation of the drive means clockwise and counterclockwise, respectively.

11. A bowling ball according to claim 10 wherein the control means comprises a radio transmitter and the control receiver comprises a radio receiver.

12. A bowling ball according to claim 11 and including battery means which are located within the spherical outer portion and electrically coupled to the drive means and to the radio receiver, the drive means being energizable by the battery means upon operation of the radio transmitter to move the weight longitudinally in opposite directions corresponding to the first and second electrical signals, respectively.

13. A bowling ball according to claim 12 and including a timing means, and having switch means engageable by the weight at the approximate midpoint of travel of the weight along the weight shaft, the switch means being in electrical circuit with the radio receiver and the timing means and operative to center the weight at the midpoint in the absence of the first and second electrical signals after a predetermined period of time.

14. A bowling ball comprising:

a spherical outer portion having a hollow interior, a portion of the hollow interior constituting an elongated weight chamber having internal first surfaces extending generally parallel to the spin axis of the ball;

an elongated, externally threaded first member supported for rotation within the weight chamber;

a motor energizable for rotating the first member about the spin axis of the ball;

an internally threaded weight carried by the first member and having second surfaces engageable with the first surfaces to constrain the weight from rotation relative to the outer portion upon rotation of the first member;

the first and second surfaces being configured to enable slidable axial movement of the weight upon rotation of the first member;

a radio receiver mounted within the spherical outer portion and electrically coupled to the motor; and a remotely located radio transmitter electrically coupled to the radio receiver and operative to generate control signals for rotating the first member selectively clockwise and counterclockwise.

15. A bowling ball according to claim 14 and including a continuous band extending around the outer surface of the ball in a plane located at an angle of approximately 90 degrees to the spin axis of the ball.

16. A bowling ball according to claim 15 and including a continuous arrangement of lights extending around the outer surface of the ball in a plane located at approximately 90 degrees to the spin axis of the ball.

* * * * *